US007043773B2

(12) United States Patent
McAleenan, Jr.

(10) Patent No.: US 7,043,773 B2
(45) Date of Patent: May 16, 2006

(54) PORTABLE FLUID COLLECTION DEVICE FOR TOILET BOWL WITH SPLASH GUARDS

(76) Inventor: Patrick M. McAleenan, Jr., 804 Kennedy Ave., Virginia Beach, VA (US) 23451

( * ) Notice: Subject to any disclaimer, the term of this patent is extended or adjusted under 35 U.S.C. 154(b) by 0 days.

(21) Appl. No.: 10/773,162

(22) Filed: Feb. 9, 2004

(65) Prior Publication Data

US 2005/0172386 A1 Aug. 11, 2005

(51) Int. Cl.
*E03D 9/00* (2006.01)
*E03D 1/22* (2006.01)
*A47K 11/12* (2006.01)

(52) U.S. Cl. ..... 4/300.3; 4/144.1; 4/342; 4/DIG. 5

(58) Field of Classification Search ..... 4/300.3, 4/342, DIG. 5, 144.1; D23/307
See application file for complete search history.

(56) References Cited

U.S. PATENT DOCUMENTS 2,600,478 A 6/1952 Butcher
2,709,816 A * 6/1955 Lamb ..... 4/239
2,791,780 A * 5/1957 Krischer ..... 434/247
2,980,919 A 4/1961 Otto et al.
3,500,480 A 3/1970 Michal, Jr.
3,822,419 A 7/1974 Wilson, Sr.
4,282,611 A 8/1981 O'Day
4,612,676 A * 9/1986 Whitman ..... 4/300.3
D394,900 S 6/1998 Kang
5,983,410 A 11/1999 Webster
6,079,057 A * 6/2000 Mette ..... 4/342

* cited by examiner

*Primary Examiner*—Charles E. Phillips
(74) *Attorney, Agent, or Firm*—Young & Thompson

(57) ABSTRACT

An adaptable hygiene device for toilets that minimizes splashing of urine by channeling male urine into the toilet bowl. The collection apparatus or device has walls (back wall (1), top wall (5), lower wall (6), side walls (7,8)) forming a container with an front opening (10) and a bottom opening (26). The front opening (10) has a continuous edge (9) that has a front splash guard (25), wherein the front splash guard (25) configuration aids in preventing urine from splashing back out of the collection device after urine has once entered the device by a male urinating. The collection apparatus has a base portion (4) having a lip (11) formed thereon, wherein the base portion (4) has an annular base rim (12) extending radially downward from the lip (11) away from the top wall (5). The base portion lip (11) contacts with the top edge of the toilet bowl or the toilet seat, wherein the base rim (12) extends into the toilet bowl. The collection device is able to be free standing in a self-supporting manner on the toilet bowl top edge or on top of the toilet seat.

21 Claims, 4 Drawing Sheets

PORTABLE FLUID COLLECTION DEVICE FOR TOILET BOWL WITH SPLASH GUARDS

FIELD OF THE INVENTION

The present invention relates to adaptable hygiene devices for toilets that minimize splashing of urine by channeling male urine into the toilet bowl.

BACKGROUND OF THE INVENTION

Most parents of young adults are mystified with the problem of finding urine spillage on the floor near and around the toilet. The spillage of urine on the floor by the young adult (or mentally challenged or elderly adults) might possibly be explained from lack of concentration or the lack of skill in aiming when urinating into the toilet. Another instance of urine spillage may be at the time the young adult is coming of age when first learning how to use the toilet. It would be desirable to have a collection device to help prevent urine spillage by the young adults on the bathroom floor. The spillage of urine creates a potential hygienic hazard from the possible means for transferring disease. Also, the spillage of urine results in an unpleasant and lingering odor. Getting to the areas of spilled urine to clean up is especially difficult when reaching behind the toilet seat and/or behind the toilet itself. It is therefore advantageous to have a collection device or apparatus to prevent unwanted splashing of urine around the toilet bowl. Parents would like to provide an atmosphere in the bathroom that has a pleasing odor, as well as being hygienic hazard free.

In reviewing the prior inventions, U.S. Pat. No. 3,500,480 issued to Michal, Jr., U.S. Pat. No. 3,822,419 issued to Wilson, Sr. and U.S. Pat. No. 4,282,611 issued to O'Day all disclose the use of a device for attachment to a toilet bowl. However, the lack of the height of the walls and the permanent or complex implementation of the devices does not allow for the easy removal over normal usage. The aspect of using brackets, clips or other means for mounting the collection device to the toilet bowl presents the difficult and complex problem of have to remove the device.

In further view of the prior invention, U.S. DES. Pat. No. 394,900 (hereafter '900) issued to Kang, U.S. Pat. No. 2,980,919 (hereafter '919) issued to Otto et al. and U.S. Pat. No. 2,600,478 (hereafter '478) issued to Butcher, all disclose devices easily removable from the toilet over normal use as well as providing high rear wall and side wall (except for Butcher) spillage protection. However, the lack of a front wall in '900 and '919 does not prevent urine spillage on the front of the toilet. Also, '478 has a very minimal target or aiming surface area creating the possibility of urine spillage over the front of the toilet. Further the use of permanent fasteners in '900 make quick and easy removal over normal usage difficult. It should also be noted in '919 that toilet bowls come in different sizes, wherein the usage of brackets or clips with an inflexible collection device will mean the device can only fit on one bowl size.

Also, in U.S. Pat. No. 5,983,410 issued to Webster is disclosed a toilet backsplash and over spray shield that is permanently installed on the toilet. However, since there is a lack of sidewalls and the minimal height of the rear wall urine can still splash on the front of the toilet, thus providing minimal protection from the splashing of urine. Furthermore, the permanency of the device to the toilet does not allow for the easy removal over normal usage.

It should be noted that urinals used in public bathrooms have specific structures, designs and usage entirely different from toilet bowls. For instance, toilet bowls are used in a residential setting for the purpose of allowing maximum usage of the collection of human waste for both men and woman. In contrast, urinals used in pubic bathrooms (or for any other possible setting) are strictly used by males and are directed for the purpose of meeting the needs of males, not females. Since urinals are used specifically for men and not woman, urinals provide a limited use in a residential setting. Furthermore, features found in urinals are meant to address the specific needs of urinals and not for toilet bowls.

Therefore, it can be noted that there exists a continuing need to have a novel collection device for a toilet which can be used by young adults (or mentally challenged and elderly adults) to urinate into a toilet. To this effect, the present invention is able to complete this need.

SUMMARY OF THE INVENTION

The present invention is contemplated to solve the aforementioned problems, and it is an object of the present invention to provide a collection apparatus that help males (young, mentally challenged and old) urinate into the toilet bowl. Accordingly, the present invention provides means for collecting or channeling urine into a toilet bowl that can be quickly and easily cleaned. The object of the present invention will have higher walls than the toilet bowl, providing means to direct male urine. The object of the present invention will have a front wall extending over the toilet bowl (described later as the lower wall as viewed in FIG. 1) preventing urine spillage onto the toilet. Further, the object of the present invention will provide a vast target or aiming surface that will prevent urine spillage. Also, the object of the present invention will be easily removable from any toilet bowl size, thus not restricting the present invention use due to the particular size of the toilet bowl. It is an object of the invention to provide a collection apparatus that can be swiftly and effortlessly installed on any toilet bowl or seat. The object of the present invention material be a flexible material so that it will fit into any size toilet bowl and be easily removable encouraging more use. It is another object to provide consumers with an affordable solution to saving time and expense from having to clean up after male misdirected urine in the bathroom. Furthermore, the present invention will be easily removable from the toilet for easy use for cleaning, thus encouraging more use of the invention.

The collection device may be economically constructed from a single sheet of molded thermoplastic or other polymer which is light weight and easy to clean. It is understood that any material may be used such as wood, metal, composite materials to construct the collection device, such that the material need not only be limited to light materials. The collection device may have at least a partial shape of mammals on land or in the water (such as lions, turtles, elephants, tigers, etc . . . ), or cartoon characters, or anabas or cell link organisms, or fish or any species thereof, aliens, or any type thereof, or ghosts, or insects or any type thereof. Targets may be placed in (such as stickers, drawings, etc), or dangling targets from inside the collection apparatus, or any means for games or entertainment outside the normal usage of the toilet.

It is to be understood that at least one embodiment of the collection apparatus is not limited in its application to the specifics of construction and the arrangements of the components to be explained in the description or drawings.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION OF THE DRAWINGS

Figure 1:
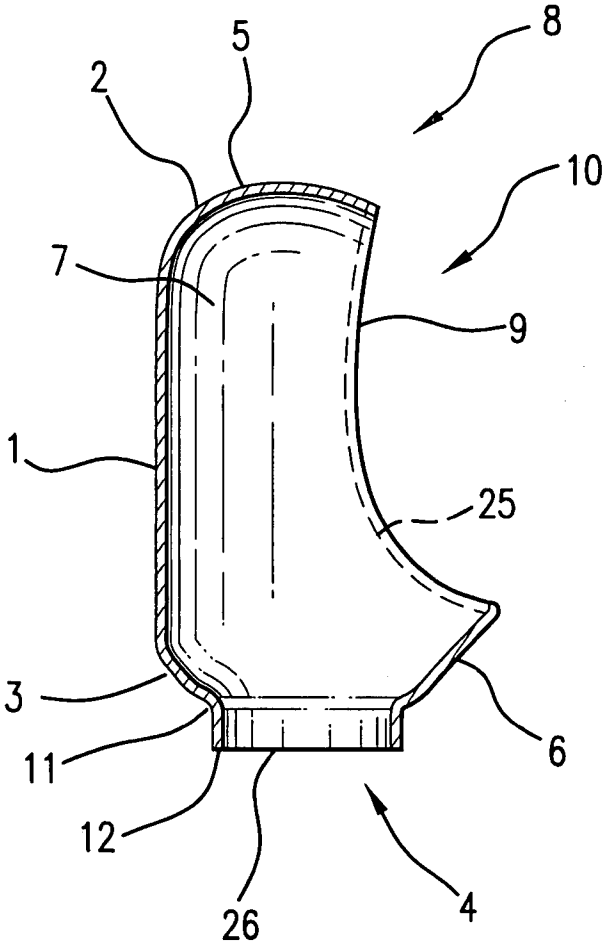
FIG. 1 illustrates a side view of the present invention.

Referring now to FIG. 1, the first embodiment of the present invention discloses a collection device adaptable to a toilet to direct urine into the toilet bowl. The device is made of a flexible material such as plastic, metal, rubber, neoprene (or any substance thereof), or polymers (or any substance thereof), composite materials, or combination of the fore mention that exhibits flexible characteristics.

Figure 4:
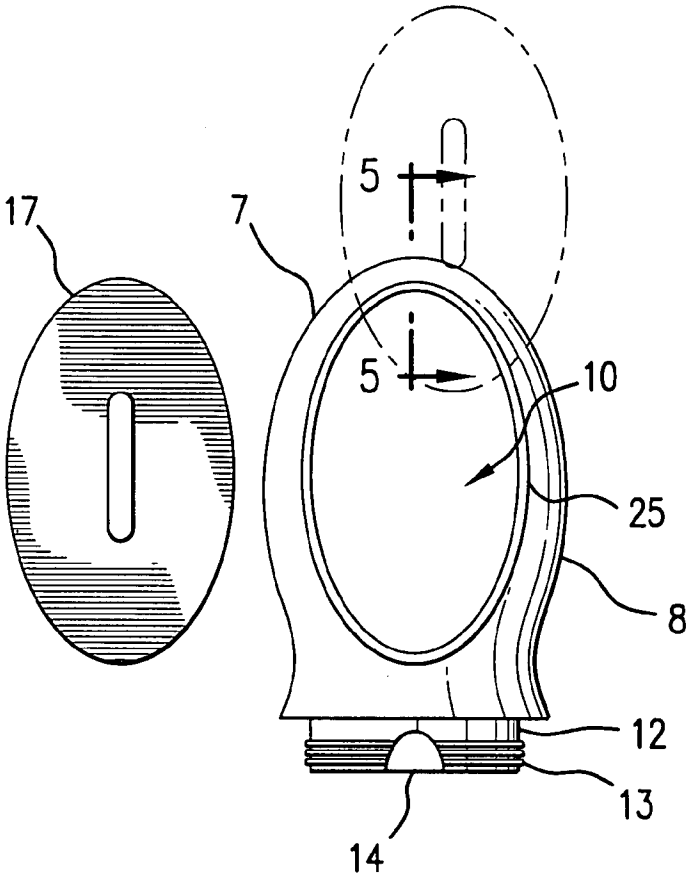
FIG. 4 illustrates an alternate front view of the present invention that includes a front cover to cover the front opening of the present invention when not in use. Also illustrated are ribs on the base rim having a U-shaped opening and a splash guard on the continuous edge of the opening.

The device according to the present invention (see FIG. 1) comprises a radial back wall (1) forming a nonlinear back plane having a back wall top edge (2) and a back wall bottom edge (3). The radial back wall (1) is angled between the ranges of 0° to 30° from vertical, either toward the toilet reserve tank or away from the toilet reserve tank, so as to provide the optimum aiming surface for a male urinating into the collection device. The radial back wall (1) has at least one curve, wherein the surface configuration aids in allowing for less splashing during use. A generally horizontal extending top wall (5) is connected to the back wall top edge (2). The back wall bottom edge (3) is connected to a base portion (4). The base portion (4) has a lower wall (6) that extends further outward than the top wall (5) in the same direction as the top wall (5). The lower wall (6) is angled toward the top wall (5) between 3° to 75° and extends outward from the base portion (4) ranging between 0 to 8 inches. The lower wall can be concaved or convexed, wherein the surface configuration aids in allowing for less splashing during use. The base portion (4) has a first side wall (7) extending radially from the base portion (4) to the top wall (5) as seen in FIG. 4. The base portion (4) has a second side wall (8) extending radially from the base portion (4) to the top wall (5) as also seen in FIG. 4. The back wall (1) and the first (7) and second (8) sidewalls extend radially (in height) from the base portion (4) preferably between 8 to 36 inches.

The back wall (1) and the first (7) and second (8) sidewalls can be concaved or convexed or any combination thereof, wherein the surface configuration aids in allowing for less splashing during use. The back wall (1) and the first (7) and second (8) sidewalls are circumferentially configured horizontally to extend from inside the toilet bowl to ranging from 0 to 10 inches circumferentially horizontally outwardly from the toilet bowl top edge. The top (5) and lower (6) walls and the first (7) and second (8) sidewalls form a continuous edge (9), wherein the continuous edge (9) forms a front opening (10). The continuous edge (9) has a front splash guard (25) as best seen in FIG. 4, wherein the configuration aids in preventing urine from splashing back out of the collection device after having once entered the device by a male urinating. The splash guard (25) configuration extends inwardly from the front opening (10) into the collection device ranging from 0 to 12 inches. The splash guard (25) also prevents urine from splashing out of the device when the device is being transfer from the toilet bowl to another location. The base portion (4) has an outwardly extending and curved at least partial radial lip (11) formed on the base portion (4). The lip (11) contacts at least partially a top edge of the toilet bowl or at least partially a toilet seat with the base rim (12) extending into the toilet bowl. The base portion (4) has at least a partial annular base rim (12) extending radially downward from the lip (11) away from the top wall (5).

Figure 2:
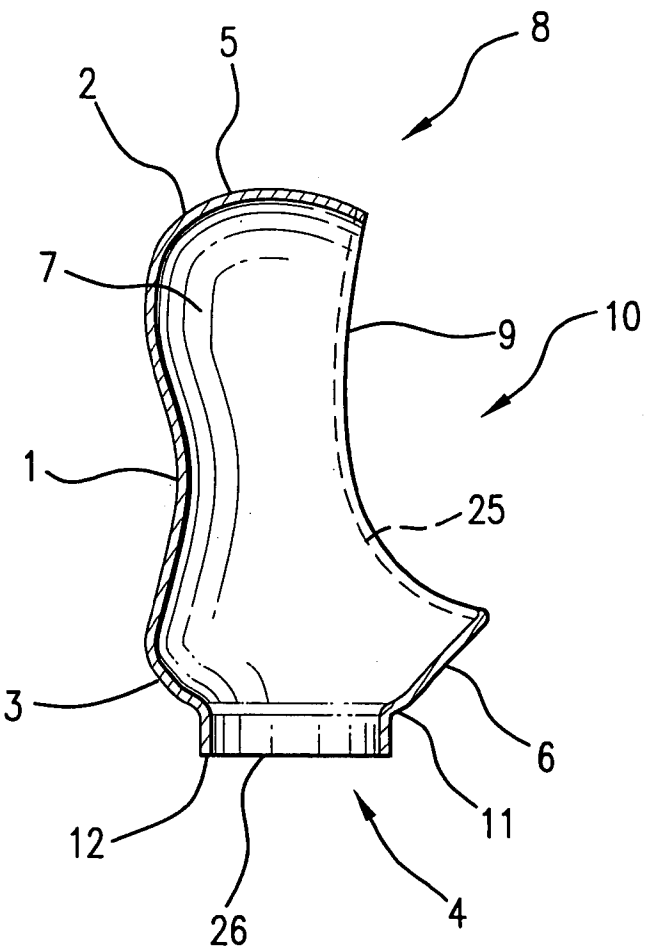
FIG. 2 illustrates an alternate side view of the present invention wherein the plane of the rear wall is a rear splash guard.

The second embodiment of the-present invention (see FIG. 2) comprises a back wall (1) having at least one curve, wherein the back plane is outwardly most toward the upper half of the back wall (1) in the direction of the back wall top edge. The back wall plane surface configuration resembles a peanut shape or rolling hills, wherein the configuration aids in allowing for less splashing during use. The ranges between each curve amplitude height from another curve amplitude height is between 0 to 12 inches, wherein each curve amplitude height is not equal to another curve amplitude height.

Figure 3:
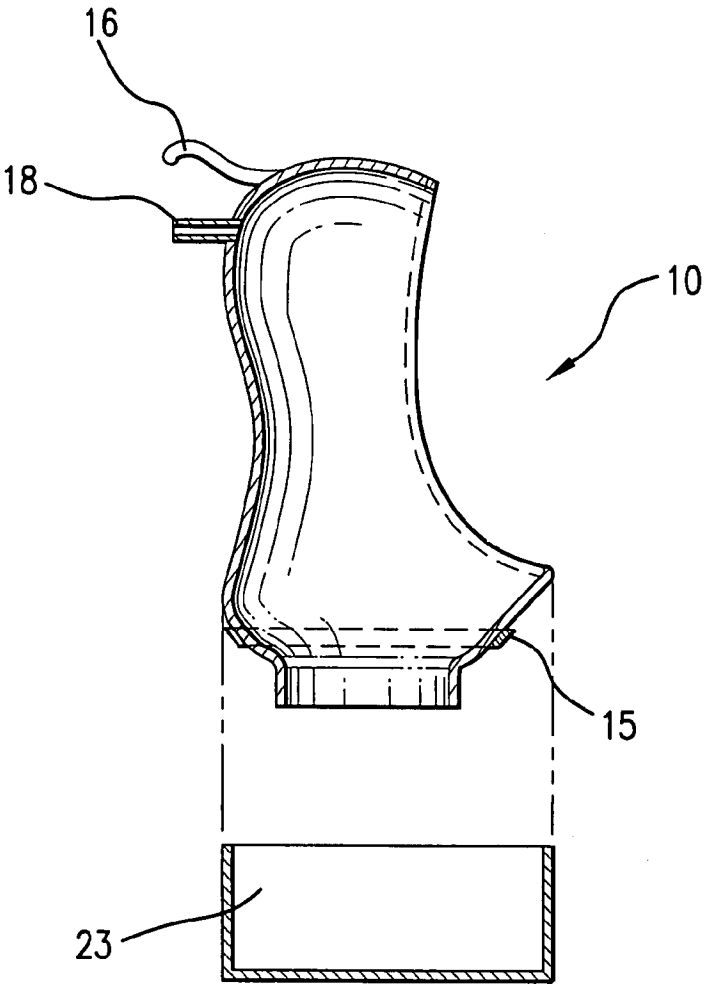
FIG. 3 illustrates an alternate side view of the present invention that includes a tray for the present invention when not in use, as well as a strap (s) to stabilize the collection device. Also illustrated is a fluid inlet port and a handle.

The third embodiment of the present invention (see FIG. 3) comprises of at least one handle (16) integral (or attached) to any part of the collection device. The handle may be glued with adhesive (or any sticking means thereof) to any part of the exterior of the collection device. When the collection device is not in use on the toilet, a tray (23) maybe used to place the collection device into. The tray (23) at least partially covers the collection device, wherein optimally covers at least up to the front opening (10) of the device.

The fourth embodiment of the present invention (see FIG. 4) comprises of a front cover (17) that at least partially covers the front opening (10). The base rim (12) has horizontally annularly extending ribs (13) that extend at least partial around the base rim (12). The ribs (13) provide stability for the collection device, as well as provide an angling means from 0° to 15° to enhance positioning of the device for better user ability. The base rim (12) can have a U-shaped cut out (14) providing for stability of the device as well as enhanced adaptability to different size toilets.

Figure 5C:
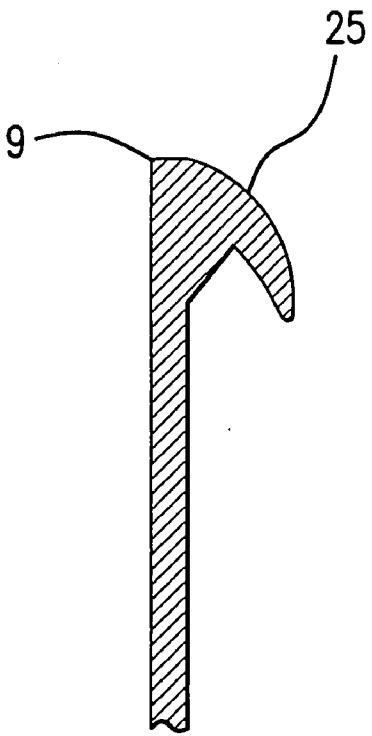
FIG. 5A–5C illustrates a side view of different embodiments of the front splash guard attached to the continuous edge of the opening.
Figure 5B:
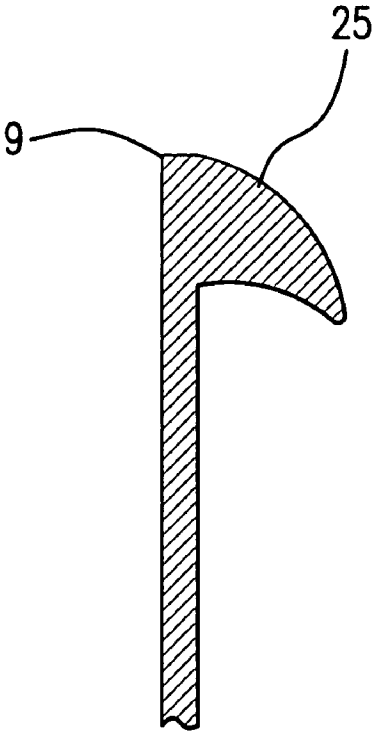
Figure 5A:
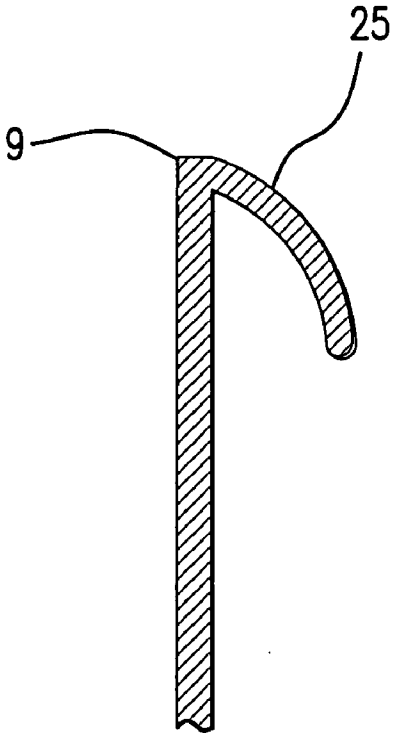

The fifth embodiment of the present invention (see FIG. 5A–FIG. 5C) comprises the continuous edge (9) having a front splash guard (25) wherein the configuration aids in preventing urine from splashing back out of the collection device after the urine having once entered the device by a male urinating. The splash guard (25) configuration extends inwardly from the front opening (10) into the collection device ranging from 0 to 12 inches. The splash guard (25) also prevents urine from splashing out of the device when the device is being transfer from the toilet bowl to another location, such as the tray (23) (see FIG. 3).

Figure 6:
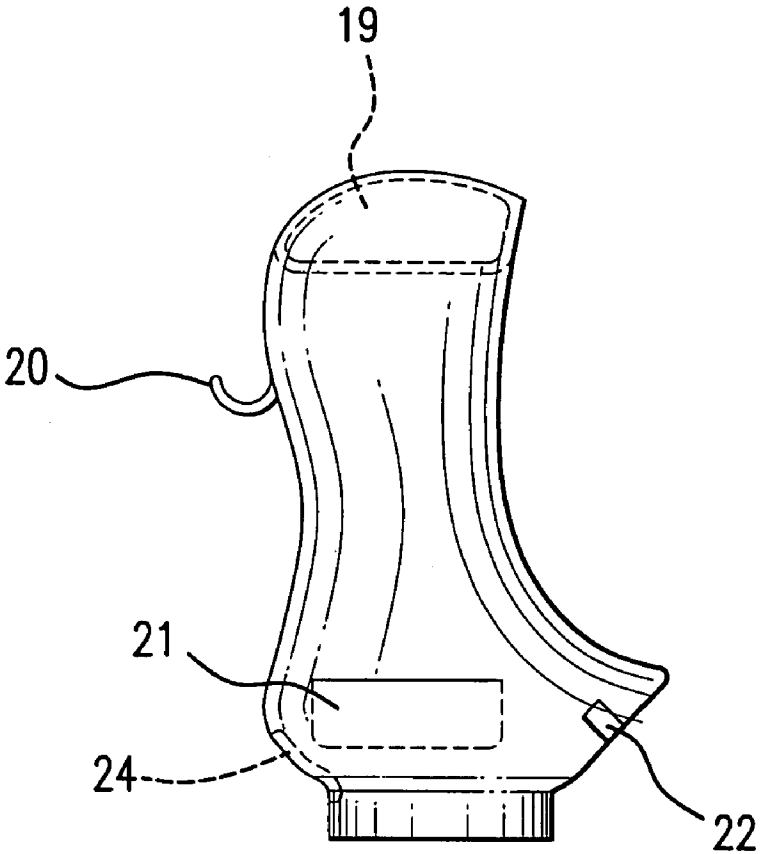
FIG. 6 illustrates an alternate side view of the present invention that includes a reservoir fluid tank, exterior & interior fastening means and a pocket. Also illustrated are vertical extending ridges on the interior surface of the present invention.

The sixth embodiment of the present invention (see FIG. 6) comprises of a reservoir fluid tank (19) that is either partially covered or not covered, wherein the fluid from the tank (19) flushing the urine from the collection device into the toilet bowl. The reservoir fluid tank (19) may have a cover or partial cover for covering the tank (19). The exterior walls of the device may have a exterior fastening means (20) for holding a fluid container used to clean the collection device. The exterior walls of the collection device may have a pocket (21) integral or attached to the device for holding a fluid container used to clean the collection device. The interior walls of the device may have an interior fastening means (22) either integral or attached for holding a sanitary device to improve the odor of the device.

In each of the embodiments, the interior walls of the device may have radially extending ridges to improve the fluid or urine flow into the toilet bowl. The ridges shape may be configured to be either rectangular, triangular, barrel, double barrel (having two mounds with a recess in the middle) shaped, or some configuration thereof. The ridges or ridge may be hollow with a slit in thereof.

The foregoing description is exemplary rather than defined by the limitations within. Many modifications and variations of the present invention are possible in light of the above teachings. The preferred embodiments of this invention are disclosed, however, one of ordinary skill in the art would recognize that certain modifications would come within the scope of this invention. Therefore, one may understand that within the scope of the appended claims, the invention may be practiced otherwise than as specifically described. For the above reason the following claims should be studied to determine the true scope and content of this invention.

I claim:

1. A collection device for collecting a fluid entering into a toilet bowl comprising:

a radial back wall (1) forming a nonlinear back surface having at least a portion thereof protruding toward a front of the device, a back wall top edge (2) and a back wall bottom edge (3), said back wall bottom edge being connected to a base portion (4), a top wall (5) extending horizontal from said back wall top edge (2), a lower wall (6) extending from said base portion (4), said lower wall (6) extending further than said top wall (5) from said back wall (1) and is angled toward said top wall (5), a first side wall (7) extending radially from said base portion (4) to said top wall (5), a second sidewall (8) extending radially from said base portion (4) to said top wall (5), a continuous edge (9) formed by said top wall (5), said lower wall (6), and said first (7) and second wall (8), wherein said continuous edge (9) has an opening (10), said continuous edge (9) including a front splash guard (25) extending therefrom, said front splash guard (25) extending into said opening toward said back wall, said splash guard reducing the fluid entering said opening into said collection device from splashing back out of said collection device through said opening, said base portion (4) having at least a partial lip (11) formed thereon, said base portion (4) having at least a partial annular base rim (12) extending radially downward from said lip (11) away from said top wall (5), wherein said lip (11) contacts at least partially a top edge of said toilet bowl or at least partially a toilet seat with the base rim extending into the toilet bowl.

2. The collection device of claim 1, wherein one of said top wall, said lower wall and said first and second side walls are non linear or curved or circular.

3. The collection device of claim 1, wherein said nonlinear back plane of said back wall forms one or more downward and backward sloping rolling waves toward said base portion that reduces splashing of said fluid into said collection device.

4. The collection device of claim 1, wherein said collection device is a single part or more than one part.

5. The collection device of claim 1, wherein said base rim section has at least one partial horizontal circumferentially extending rib about said base rim section for stabilizing said collection device to said toilet.

6. The collection device of claim 1, wherein said base rim has at least one section with at least one U-shaped cut out for stabilizing or securing said collection device to the toilet.

7. The collection device of claim 1, wherein one of said back wall, said first and second side walls, said top wall, said lower wall, and said base portion has at least one strap for stabilizing said collection device to the toilet.

8. The collection device of claim 1, wherein one of said back wall, said first and second side walls, said top wall, said lower wall, and said base portion has at least one handle.

9. The collection device of claim 1, wherein a detachable front cover at least partially covers said opening.

10. The collection device of claim 1, wherein one of said back wall, said first and second side walls, said top wall, said lower wall, and said base portion has at least one inlet fluid port for a rinsing fluid to enter said collection device.

11. The collection device of claim 1, wherein one of said back wall, said first and second side walls, said top wall, said lower wall, and said base portion has at least one reservoir fluid tank covering or partially covering or not covering that holds a rinsing fluid to be dispensed into said collection device.

12. The collection device of claim 1, wherein said collection device has a fixed or detachable rinsing fluid container attached to said collection device.

13. The collection device of claim 1, wherein said collection device has a pocket integral with said collection device to hold said rinsing fluid container, or wherein said collection device has an integral horizontal surface for holding said rinsing fluid container.

14. The collection device of claim 1, wherein one of said back wall, said first and second side walls, said top wall, said lower wall, and said base portion has interior fastening means for at least one sanitary device inside of said collection device for improving odor smell and hygiene.

15. The collection device of claim 1, wherein said collection device has an external tray for said collection device when not positioned on said toilet bowl.

16. The collection device of claim 1, wherein said base portion forms a volute.

17. The collection device of claim 16, wherein said volute has at least one partial extending radial ridge for increasing flow of the fluid.

18. The collection device as claimed in claim 1, wherein said splash guard extends into said opening up to 12 inches.

19. The collection device of claim 1, wherein the lower wall extends at least to the end front edge of the toilet bowl.

20. A collection device for fluid into a toilet bowl comprising:

a radial back wall (1) forming a nonlinear back surface having at least a portion thereof protruding toward a front of the device, a back wall top edge (2) and a back wall bottom edge (3), said back wall bottom edge being connected to a base portion (4), a top wall (5) extending horizontal from said back wall top edge (2), a lower wall (6) extending horizontal from said base portion (4), said lower wall (6) extending further than said top wall (5) from said back wall (1) and is angled toward said top wall (5), a first side wall (7) extending radially from said base portion (4) to said top wall (5), a second sidewall (8) extending radially from said base portion (4) to said top wall (5), a continuous edge (9) formed by said top wall (5), said lower wall (6), and said first (7) and second wall (8), wherein said continuous edge (9) forms an opening (10), said continuous edge (9) including a front splash guard (25) extending therefrom into said collection device, said front splash guard (25) extending into said opening toward said back wall, said splash guard reducing the fluid entering said opening into said collection device from splashing back out of said collection device through said opening, said base portion (4) having at least a partial lip (11) formed thereon, said base portion (4) having at least a partial annular rim (12) extending radially downward from said lip (11) away from said top wall (5), wherein said lip (11) contacts at least partially a top edge of said toilet bowl or at least partially a toilet seat with the rim extending therein.

21. A device for collecting fluid discharge from a male into a toilet bowl comprising:

a back wall (1) providing means for reducing splash from said fluid into said collection device, wherein said back wall is connected to a base portion (4), a top wall (5) and lower wall (6) extending from said back wall (1), a first side wall (7) and second sidewall (8) extending from said base portion (4), a continuous edge (9) formed by said top wall (5), said lower wall (6), and said first (7) and second wall (8), wherein said continuous edge (9) forms an opening (10), and a splash guard extending from said continuous edge into said opening towards the back wall, said splash guard reducing the fluid entering said opening into said collection device from splashing back out of said collection device through said opening, said base portion (4) having at least a partial lip (11) formed thereon, said base portion (4) having at least a partial annular rim (12) extending radially downward from said lip (11) away from said top wall (5), wherein said lip (11) contacts at least partially a top edge of said toilet bowl or at least partially a toilet seat with the rim extending therein.

* * * * *